US010522104B2

(12) United States Patent
Xu

(10) Patent No.: US 10,522,104 B2
(45) Date of Patent: Dec. 31, 2019

(54) LIQUID CRYSTAL PANEL DRIVING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Xiangyang Xu, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 185 days.

(21) Appl. No.: 15/562,707

(22) PCT Filed: Jul. 21, 2017

(86) PCT No.: PCT/CN2017/093770
§ 371 (c)(1),
(2) Date: Sep. 28, 2017

(87) PCT Pub. No.: WO2019/000516
PCT Pub. Date: Jan. 3, 2019

(65) Prior Publication Data

US 2019/0272795 A1 Sep. 5, 2019

(30) Foreign Application Priority Data

Jun. 29, 2017 (CN) ..... 2017 1 0513968

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01); *G09G 3/36* (2013.01); *G09G 3/3611* (2013.01);
(Continued)

(58) Field of Classification Search
CPC ..... G09G 3/3648; G09G 3/006; G09G 2300/043; G09G 2310/08; G09G 2320/0673; G09G 2330/021
See application file for complete search history.

(56) References Cited

U.S. PATENT DOCUMENTS

2002/0027540 A1 3/2002 Lee
2002/0175886 A1* 11/2002 Ham ..... G09G 3/36 345/87

(Continued)

FOREIGN PATENT DOCUMENTS

CN 101211036 A 7/2008
CN 101324715 A 12/2008

(Continued)

OTHER PUBLICATIONS

Office Action and Search Report, dated May 28, 2018, for Chinese Patent Application No. 201710513968.8.

(Continued)

*Primary Examiner* — Stephen G Sherman

(57) ABSTRACT

Disclosed is a liquid crystal panel driving circuit and a liquid crystal display device. The driving circuit includes a power integrated circuit module, a timing control module, a compensation module, and a temperature sensor. In the driving circuit, the power integrated circuit module and the timing control module adjust a DC low voltage or a clock signal according to a compensating parameter and then output the adjusted DC low voltage or clock signal to a liquid crystal panel. In this way, a working voltage and a working temperature of a TFT in the liquid crystal panel can match each other, whereby the reliability of the liquid crystal panel is improved.

15 Claims, 4 Drawing Sheets

(52) U.S. Cl.
CPC ... *G09G 2300/043* (2013.01); *G09G 2310/08* (2013.01); *G09G 2320/041* (2013.01); *G09G 2320/0673* (2013.01); *G09G 2330/021* (2013.01)

(56) References Cited

U.S. PATENT DOCUMENTS

2005/0231496 A1* 10/2005 Kim ..... G09G 3/3696 345/204
2006/0033852 A1* 2/2006 Kim ..... G09G 3/006 349/38
2008/0309609 A1* 12/2008 Feng ..... G09G 3/3677 345/101

FOREIGN PATENT DOCUMENTS

CN 102005197 A 4/2011
CN 103198782 A 7/2013
CN 104778934 A 7/2015
CN 106157915 A 11/2016

OTHER PUBLICATIONS

Search Report and Written Opinion, dated Mar. 29, 2018, for International Application No. PCT/CN2017/093770.

* cited by examiner

LIQUID CRYSTAL PANEL DRIVING CIRCUIT AND LIQUID CRYSTAL DISPLAY DEVICE

CROSS-REFERENCE TO RELATED APPLICATIONS

This application claims the priority of Chinese patent application CN 201710513968.8, entitled "Liquid crystal panel driving circuit and liquid crystal display device" and filed on Jun. 29, 2017, the entirety of which is incorporated herein by reference.

FIELD OF THE INVENTION

The present disclosure relates to the technical field of liquid crystal displaying, and in particular, to a liquid crystal panel driving circuit and a liquid crystal display device.

BACKGROUND OF THE INVENTION

With the development of flat panel display technologies, it has become a trend in developing flat display panels with high resolution, high contrast, high refresh rate, narrow bezel, and small thickness. At present, liquid crystal panels are still mainstream products of flat panel display technologies. In order to realize narrow bezel, small thickness, and low cost of liquid crystal display panels, GOA technology is greatly developed and has been well used.

FIG. 1 schematically shows a GOA circuit. The GOA circuit comprises a pull-up control module A, a pull-up module B, a pull-down module C, a first pull-down holding module D1, and a second pull-down holding module D2. When point G(n−3) is at a high level, point Q(n) is charged and pulled high, at which time T21 is turned on, and a high level of CLK pulls point G(n) high and outputs a high-level scanning signal. When point G(n+3) is at a high level, the pull-down module pulls the point G(n) and the point Q(n) down simultaneously, and operating points of the pull-down holding module are the low level of G(n) and a high level of point LC1 (or LC2). A GOA control timing diagram is as shown in FIG. 2. LC1 and LC2 are low-frequency signals having periods twice a frame period and having ½ duty cycles, and a phase difference between LC1 and LC2 is ½ period. Control signals needed by the GOA circuit in operation include clock signals, synchronous trigger signals, low-frequency pull-down holding control signals, and VSS low-voltage signals.

A GOA circuit is formed by a plurality of field-effect thin film transistors (TFT). Voltages at operating points of TFTs are closely related to operating environment. Panels are usually operated at normal temperature environment (about 25° C.). Because of heat produced by the circuit in operation, temperature inside a panel can reach above 40° C., and temperature of a GOA area can reach up to above 70° C. Temperature of a working environment of a panel can be as low as −50° C. considering that the panel may be used in severely cold areas. A working temperature of a GOA circuit can therefore actually range from −60° C. to 80° C. In order to satisfy a certain temperature scope of the working environment, a cut-in voltage of a GOA circuit is purposely increased to above 30 V when a driving circuit is designed. It is known from a reliability test of a GOA circuit that when temperature is increased, a TFT in the GOA circuit needs a higher working voltage, while when temperature is decreased, the TFT in the GOA circuit needs a lower cut-in voltage. Voltage at an operating point of a TFT can directly affect service life of the TFT. If the TFT uses a high working voltage at high temperature, the TFT will decay quickly. If the working voltage of the TFT is not increased at low temperature, normal output of gate scanning signal will be affected, which can reduce charging rate.

FIG. 3 shows a driving circuit of a GOA liquid crystal panel. The circuit comprises a power integrated circuit (power IC), a timing control circuit (Tcon circuit), a gamma module, and a source integrated circuit (source IC). The power IC is configured to supply a voltage source to each driving module and a panel. The Tcon circuit is configured to provide control signals for the source IC and a GOA circuit of the panel in operation. The gamma module is configured to provide a reference voltage which is needed by the source IC during digital-to-analogue conversion. The source IC is mainly configured to convert digital gray scale signals to liquid crystal voltages which are applied on two sides of liquid crystals. Control signals provided by the Tcon circuit include starting signal (STV)/clock signal (CLK)/low-frequency clock driving signal (LC). High and low levels of these signals are usually fixed values. A high level of the CLK is a high level outputted by the GOA circuit, and DC low voltage (VSS) is a low level outputted by the GOA circuit.

SUMMARY OF THE INVENTION

The present disclosure provides a liquid crystal panel driving circuit and a liquid crystal display device, which are intended to solve the problem in the prior art that a working voltage and a working temperature of a TFT in a GOA circuit does not match, which leads to decay of the TFT.

The present disclosure, at one aspect, provides a liquid crystal panel driving circuit which comprises a power integrated circuit module, a timing control module, a compensation module, and a temperature sensor. The temperature sensor is connected with the power integrated circuit module and the compensation module, respectively, and is used to obtain a working temperature of the liquid crystal panel driving circuit from the power integrated circuit module, and to send the working temperature to the compensation module. The compensation module is further connected with the power integrated circuit module and the timing control module, and is used to obtain a corresponding compensating parameter according to the working temperature, and to send the compensating parameter to the power integrated circuit module and/or the timing control module. The power integrated circuit module is further connected with the timing control module, and is used to supply a voltage source for the timing control module, and to output a DC low voltage. The timing control module is used to provide a control signal needed by the liquid crystal panel in operation.

Preferably, the compensation module includes a compensation table which shows correspondence relations between the working temperature and first and second compensating subparameters, and the compensating parameter includes the first compensating subparameter and the second compensating subparameter.

Preferably, the compensation module comprises a storage device where the compensation table is stored in advance.

Preferably, the liquid crystal panel driving circuit further comprises a gamma module and a source integrated circuit module. The gamma module is connected with the power integrated circuit module and the source integrated circuit module, respectively, and is used to provide a reference voltage needed by the source integrated circuit module during digital-to-analogue conversion. The source integrated circuit module is further connected with the timing control module, and is used to convert a digital gray scale signal provided by the timing control module to a liquid crystal voltage.

The present disclosure, at another aspect, provides a liquid crystal display device. The liquid crystal display device comprises a liquid crystal panel and the aforementioned liquid crystal panel driving circuit connected with the liquid crystal panel. The liquid crystal panel driving circuit comprises a power integrated circuit module, a timing control module, a compensation module, and a temperature sensor. The temperature sensor is connected with the power integrated circuit module and the compensation module, respectively, and is used to obtain a working temperature of the liquid crystal panel driving circuit from the power integrated circuit module, and to send the working temperature to the compensation module. The compensation module is further connected with the power integrated circuit module and the timing control module, and is used to obtain a corresponding compensating parameter according to the working temperature, and to send the compensating parameter to the power integrated circuit module and/or the timing control module. The power integrated circuit module is further connected with the timing control module, and is used to supply a voltage source for the timing control module, and to output a DC low voltage to the liquid crystal panel. The timing control module is used to provide a control signal needed by the liquid crystal panel in operation.

Preferably, the compensation module includes a compensation table which shows correspondence relations between the working temperature and first and second compensating subparameters, and the compensating parameter includes the first compensating subparameter and the second compensating subparameter.

Preferably, the compensation module comprises a storage device where the compensation table is stored in advance.

Preferably, the liquid crystal panel driving circuit further comprises a gamma module and a source integrated circuit module. The gamma module is connected with the power integrated circuit module and the source integrated circuit module, respectively, and is used to provide a reference voltage needed by the source integrated circuit module during digital-to-analogue conversion. The source integrated circuit module is further connected with the timing control module, and is used to convert a digital gray scale signal provided by the timing control module to a liquid crystal voltage.

Preferably, the power integrated circuit module is further used to provide an array substrate common electrode signal and a color filter substrate common electrode signal for the liquid crystal panel.

According to the liquid crystal panel driving circuit and the liquid crystal display device provided by the present disclosure, the temperature sensor obtains the working temperature, and then the compensation module obtains a corresponding compensating parameter according to the working temperature; the power integrated circuit module and/or the timing control module adjusts the DC low voltage or the clock signal according to the compensating parameter and outputs the adjusted DC low voltage or the clock signal to the liquid crystal panel, so that the working voltage and the working temperature of the TFT match each other, whereby the reliability of the liquid crystal panel is improved, the service life of the GOA circuit is extended, and meanwhile the display effect of the liquid crystal panel is enhanced and its power consumption is reduced.

BRIEF DESCRIPTION OF THE DRAWINGS

The accompanying drawings provide further understandings of the present disclosure or the prior art, and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
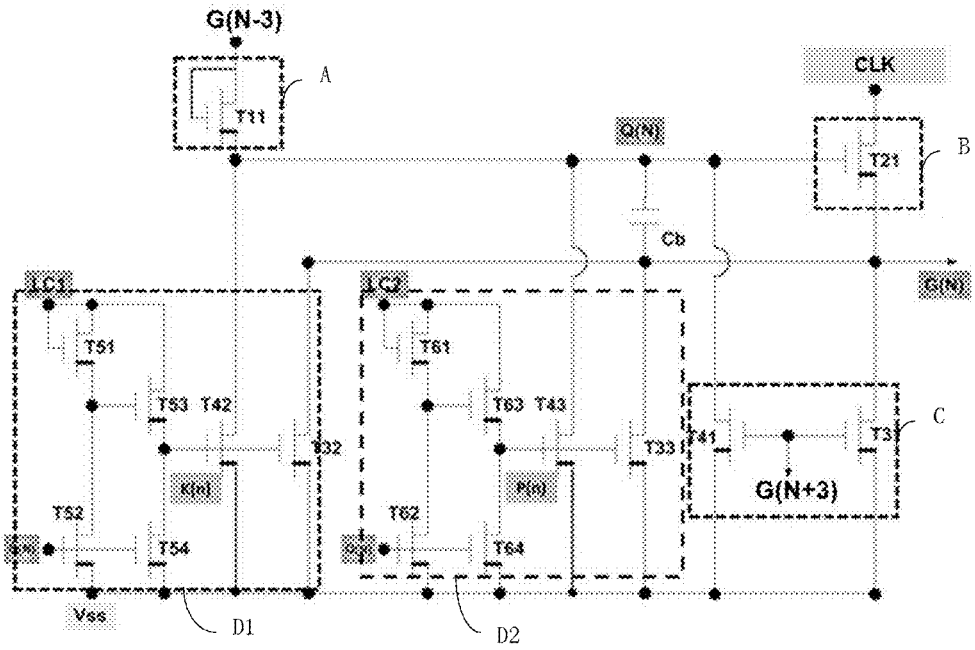
Fig. 1 (Prior Art)
FIG. 1 schematically shows a GOA circuit of the prior art.
Figure 2:
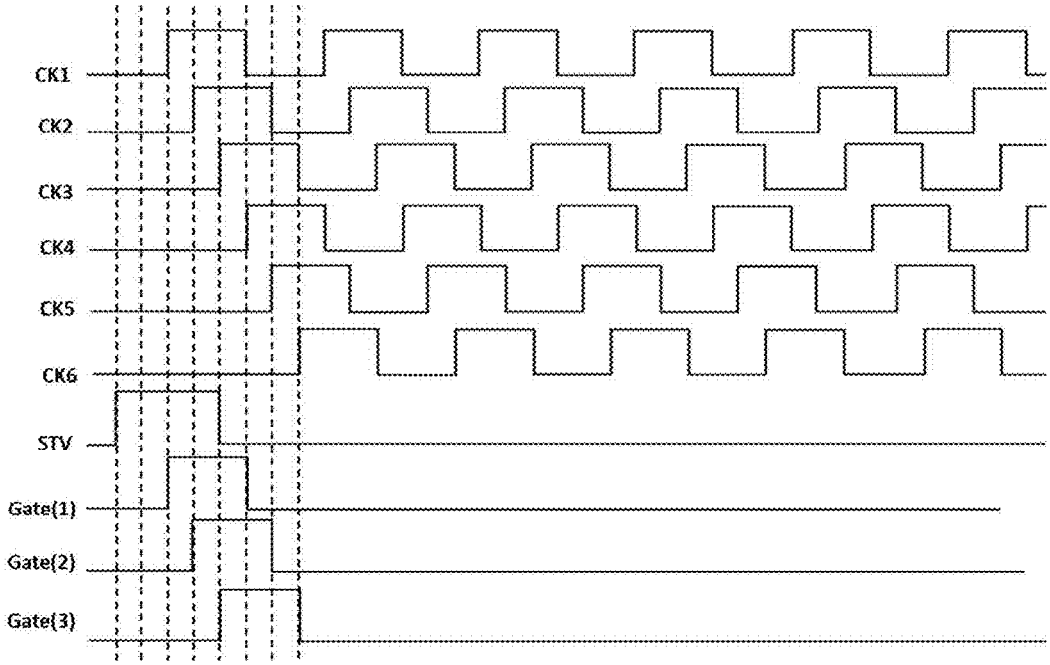
Fig. 2 (Prior Art)
FIG. 2 is a control signal timing diagram of the GOA circuit of the prior art.
Figure 3:
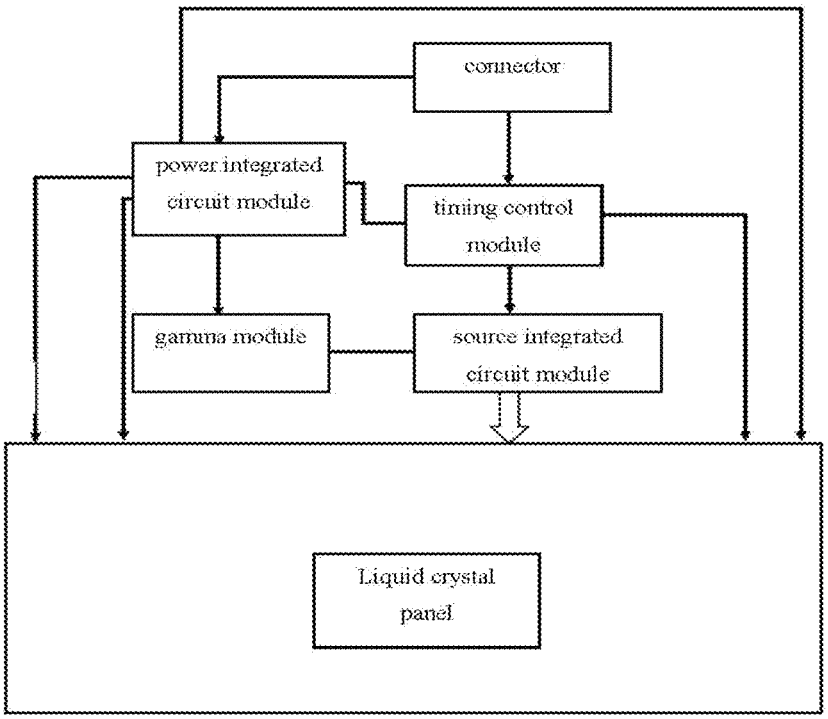
Fig. 3 (Prior Art)
FIG. 3 schematically shows a driving circuit of a GOA liquid crystal panel of the prior art.
Figure 4:
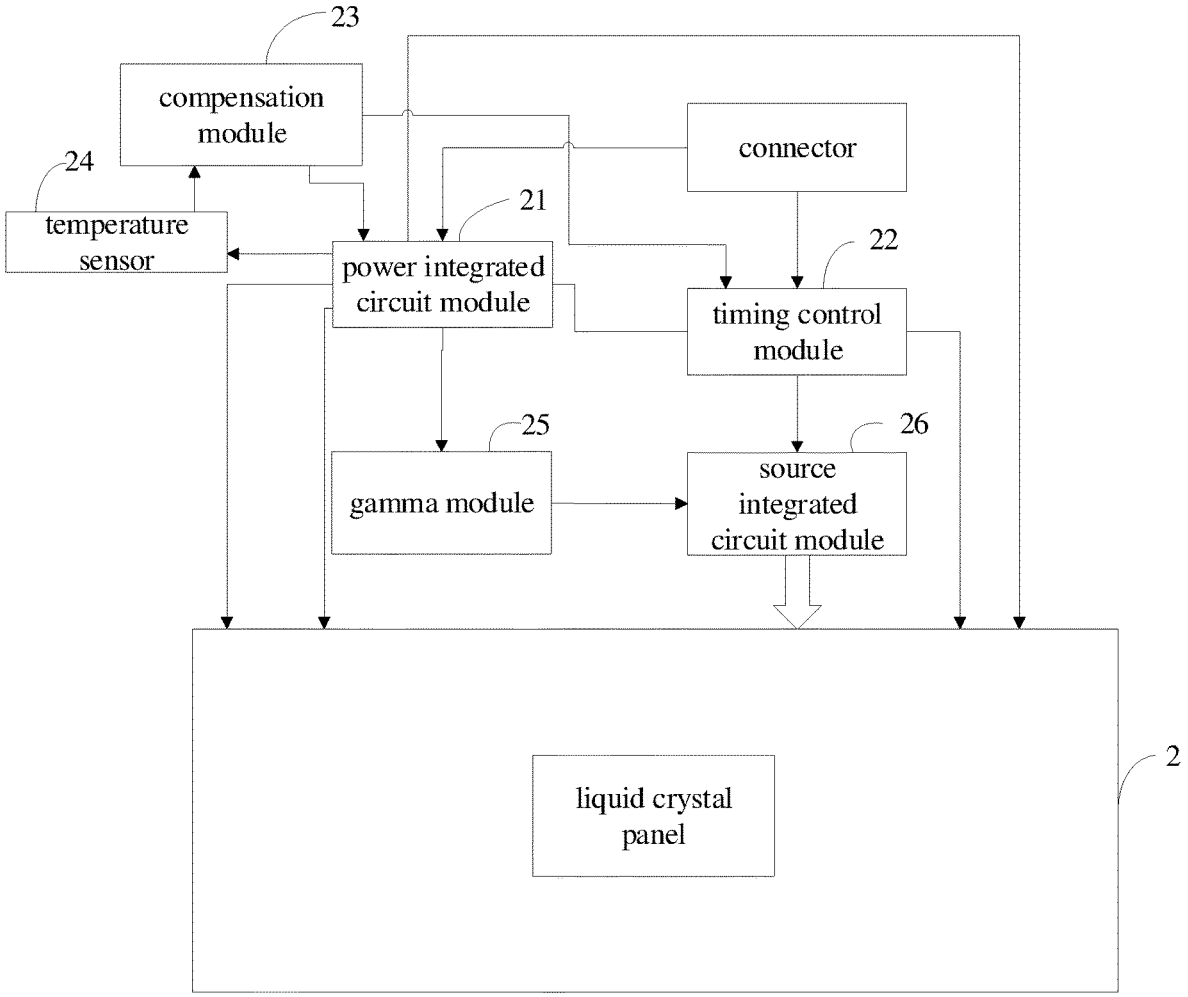
FIG. 4 schematically shows structure of a liquid crystal panel driving circuit of the present disclosure.

FIG. 4 schematically shows structure of a liquid crystal panel driving circuit of embodiments of the present disclosure. As shown in FIG. 4, the present embodiment provides a liquid crystal panel driving circuit, which comprises a power integrated circuit module 21, a timing control module 22, a compensation module 23, and a temperature sensor 24.

The temperature sensor 24 is connected with the power integrated circuit module 21 and the compensation module 23, and is used to obtain a working temperature of the liquid crystal panel driving circuit from the power integrated circuit module 21, and to send the working temperature to the compensation module 23. The compensation module 23 is further connected with the power integrated circuit module 21 and the timing control module 22, and is used to obtain a corresponding compensating parameter according to the working temperature, and to send the compensating parameter to the power integrated circuit module 21 and/or the timing control module 22. The power integrated circuit module 21 is further connected with the timing control module 22, and is used to supply a voltage source for the timing control module 22, and to output a DC low voltage. The timing control module 22 is used to provide a control signal needed by the liquid crystal panel in operation.

In the present embodiment, the temperature sensor 24 can be provided in or outside the power integrated circuit module 21. Specific arrangement of the temperature sensor 24 can be selected based on practical needs and is not limited herein. The temperature sensor 24 is used to obtain a working temperature of the power integrated circuit module 21. Because the power integrated circuit module 21 and the liquid crystal panel are operated in same environment, the working temperature of the power integrated circuit module 21 can be taken as the working temperature of the liquid crystal panel (also a working temperature of the GOA circuit).

The timing control module 22 is used to provide a control signal needed by the liquid crystal panel in operation. Apart from this, the timing control module 22 is also configured to provide image data signal. The control signal provided by the timing control module 22 for the GOA circuit includes a starting signal (STV)/a clock signal (CLK)/a low-frequency clock driving signal (LC). High and low levels of these signals are usually fixed values. The compensation module 23 is configured to obtain a corresponding compensating parameter according to the working temperature sent by the temperature sensor 24. The compensation module 23 includes a compensation table which shows correspondence relations between the working temperature and first and second compensating subparameters. The compensating parameter includes the first compensating subparameter and the second compensating subparameter. Further, the compensation module comprises a storage device where the compensation table is stored in advance. The compensation module 23, by looking up the compensation table, finds the first compensating subparameter and the second compensating subparameter that are corresponding to the working temperature. Specifically, the first compensating subparameter is VGH (a cut-in voltage of a TFT) and the second compensating subparameter is Vss1. The compensation module 23 sends the first compensating subparameter that it found to the timing control module 22, and sends the second compensating subparameter that it found to the power integrated circuit module 21. When the compensation module 23 fails to find a first compensating subparameter or a second compensating subparameter that corresponds to the working temperature, the compensation module 23 does not send a first compensating subparameter or a second compensating subparameter to a corresponding module. The power integrated circuit module 21 adjusts the DC low voltage (VSS) based on the first compensating subparameter and then outputs the adjusted DC low voltage to the liquid crystal panel; the timing control module 22 adjusts the clock signal (CLK) according to the second compensating subparameter and then outputs the adjusted clock signal to the liquid crystal panel, so that a working voltage and a working temperature of a TFT in the liquid crystal panel match each other. By way of this, the reliability of the liquid crystal panel is improved, service life of the GOA circuit is extended, and in the meantime the display effect of the liquid crystal panel is enhanced and its power consumption is reduced.

In one specific embodiment of the present disclosure, the above liquid crystal panel driving circuit further comprises a gamma module 25 and a source integrated circuit module 26. The gamma module 25 is connected with the power integrated circuit module 21 and the source integrated circuit module 26, respectively, and is used to provide a reference voltage needed by the source integrated circuit module 26 during digital-to-analogue conversion. The source integrated circuit module 26 is further connected with the timing control module 22, and is used to convert a digital gray scale signal provided by the timing control module 22 to a liquid crystal voltage. The image data signal includes the digital gray scale signal and is sent to the source integrated circuit module 26 by the timing control module 22.

The embodiments of the present disclosure further provide a liquid crystal display device, which comprises a liquid crystal panel 2 and a liquid crystal panel driving circuit as described in the above embodiments. The liquid crystal panel driving circuit comprises a power integrated circuit module 21, a timing control module 22, a compensation module 23, and a temperature sensor 24. The temperature sensor 24 is connected with the power integrated circuit module 21 and the compensation module 23, respectively, and is used to obtain a working temperature of the liquid crystal panel driving circuit from the power integrated circuit module 21, and to send the working temperature to the compensation module 23. The compensation module 23 is further connected with the power integrated circuit module 21 and the timing control module 22, and is used to obtain a corresponding compensating parameter according to the working temperature, and to send the compensating parameters to the power integrated circuit module 21 and/or the timing control module 22. The power integrated circuit module 21 is further connected with the timing control module 22, and is used to supply a voltage source for the timing control module 22, and to output a DC low voltage to the liquid crystal panel. The timing control module 22 is used to provide a control signal needed by the liquid crystal panel in operation.

Further, the compensation module 23 includes a compensation table which shows correspondence relations between the working temperature and first and second compensating subparameters. The compensating parameter includes the first compensating subparameter and the second compensating subparameter.

Further, the compensation module 23 comprises a storage device where the compensation table is stored in advance.

Further, the liquid crystal panel driving circuit further comprises a gamma module 25 and a source integrated circuit module 26. The gamma module 25 is connected with the power integrated circuit module 21 and the source integrated circuit module 26, respectively, and is used to provide a reference voltage needed by the source integrated circuit module 26 during digital-to-analogue conversion. The source integrated circuit module 26 is further connected with the timing control module 22, and is used to convert a digital gray scale signal provided by the timing control module 22 to a liquid crystal voltage.

Further, the power integrated circuit module 21 is also used to provide an array substrate common electrode signal (A_com) and a color filter substrate common electrode signal (CT_com) for the liquid crystal panel 2.

The above embodiments are described only for better understanding, rather than restricting the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A liquid crystal panel driving circuit, comprising a power integrated circuit module, a timing control circuit module, a compensation circuit module, and a temperature sensor, wherein the temperature sensor is connected with the power integrated circuit module and the compensation circuit module, respectively, and is used to obtain a working temperature of the liquid crystal panel driving circuit from the power integrated circuit module, and to send the working temperature to the compensation circuit module, wherein the compensation circuit module is further connected with the power integrated circuit module and the timing control circuit module, and is used to obtain a corresponding compensating parameter according to the working temperature, and to send the compensating parameter to the power integrated circuit module and the timing control circuit module, wherein the power integrated circuit module is further connected with the timing control circuit module, and is used to supply a voltage source for the timing control circuit module, and to output a DC low voltage; wherein the power integrated circuit module is used to adjust the DC low voltage according to the compensating parameter; and wherein the timing control circuit module is used to provide a control signal needed by the liquid crystal panel in operation; wherein the timing control circuit module is used to adjust a clock signal according to the compensating parameter.

2. The liquid crystal panel driving circuit according to claim 1, wherein the compensation circuit module includes a compensation table which shows correspondence relations between the working temperature and first and second compensating subparameters, and wherein the compensating parameter includes the first compensating subparameter and the second compensating subparameter.

3. The liquid crystal panel driving circuit according to claim 2, wherein the compensation circuit module comprises a storage device where the compensation table is stored.

4. The liquid crystal panel driving circuit according to claim 3, further comprising a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

5. The liquid crystal panel driving circuit according to claim 2, further comprising a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

6. The liquid crystal panel driving circuit according to claim 1, further comprising a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

7. A liquid crystal display device, comprising a liquid crystal panel and a liquid crystal panel driving circuit connected with the liquid crystal panel, wherein the liquid crystal panel driving circuit comprises a power integrated circuit module, a timing control circuit module, a compensation circuit module, and a temperature sensor, wherein the temperature sensor is connected with the power integrated circuit module and the compensation circuit module, respectively, and is used to obtain a working temperature of the liquid crystal panel driving circuit from the power integrated circuit module, and to send the working temperature to the compensation circuit module, wherein the compensation circuit module is further connected with the power integrated circuit module and the timing control circuit module, and is used to obtain a corresponding compensating parameter according to the working temperature, and to send the compensating parameter to the power integrated circuit module and/or the timing control circuit module, wherein the power integrated circuit module is further connected with the timing control circuit module, and is used to supply a voltage source for the timing control circuit module, and to output a DC low voltage to the liquid crystal panel; wherein the power integrated circuit module is used to adjust the DC low voltage according to the compensating parameter; and wherein the timing control circuit module is used to provide a control signal needed by the liquid crystal panel in operation; wherein the timing control circuit module is used to adjust a clock signal according to the compensating parameter.

8. The liquid crystal display device according to claim 7, wherein the compensation circuit module includes a compensation table which shows correspondence relations between the working temperature and first and second compensating subparameters, and wherein the compensating parameter includes the first compensating subparameter and the second compensating subparameter.

9. The liquid crystal display device according to claim 8, wherein the compensation circuit module comprises a storage device where the compensation table is stored.

10. The liquid crystal display device according to claim 9, wherein the liquid crystal panel driving circuit further comprises a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

11. The liquid crystal display device according to claim 9, wherein the power integrated circuit module is further used to provide an array substrate common electrode signal and a color filter substrate common electrode signal for the liquid crystal panel.

12. The liquid crystal display device according to claim 8, wherein the liquid crystal panel driving circuit further comprises a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

13. The liquid crystal display device according to claim 8, wherein the power integrated circuit module is further used to provide an array substrate common electrode signal and a color filter substrate common electrode signal for the liquid crystal panel.

14. The liquid crystal display device according to claim 7, wherein the liquid crystal panel driving circuit further comprises a gamma circuit module and a source integrated circuit module, wherein the gamma circuit module is connected with the power integrated circuit module and the source integrated circuit module, respectively, and is used to provide a reference voltage needed by the source integrated circuit module during digital-to-analogue conversion, and wherein the source integrated circuit module is further connected with the timing control circuit module, and is used to convert a digital gray scale signal provided by the timing control circuit module to a liquid crystal voltage.

15. The liquid crystal display device according to claim 7, wherein the power integrated circuit module is further used to provide an array substrate common electrode signal and a color filter substrate common electrode signal for the liquid crystal panel.

* * * * *